United States Patent [19]

Oikawa et al.

[11] Patent Number: 5,013,775

[45] Date of Patent: May 7, 1991

[54] SIZING COMPOSITION AND SIZING METHOD

[75] Inventors: Hideo Oikawa, Iwakuni; Masatomi Ogawa, Ichihara; Kiyoshi Iwai; Mayumi Narushima, both of Chiba, all of Japan

[73] Assignee: DIC-Hercules Chemicals, Inc., Tokyo, Japan

[21] Appl. No.: 343,903

[22] Filed: Apr. 27, 1989

[30] Foreign Application Priority Data

Apr. 28, 1988 [JP] Japan ..... 63-104204
Apr. 28, 1988 [JP] Japan ..... 63-104205

[51] Int. Cl.[5] ..... C08K 5/15

[52] U.S. Cl. ..... 524/107; 524/365; 524/555

[58] Field of Search ..... 524/107, 365, 555

[56] References Cited

U.S. PATENT DOCUMENTS 4,425,469 1/1984 Emmons et al. ..... 524/389
4,654,386 3/1987 Hara et al. ..... 524/107

*Primary Examiner*—Joseph L. Schofer
*Assistant Examiner*—Jeffrey T. Smith
*Attorney, Agent, or Firm*—Oblon, Spivak, McClelland, Maier & Neustadt

[57] ABSTRACT

A novel paper sizing composition comprising a ketene dimer and a hydrophilic vinyl polymer containing an alkylmercaptan having 6-22 carbon atoms. The composition has excellent storage and mechanical stability and sizing effect.

13 Claims, No Drawings

SIZING COMPOSITION AND SIZING METHOD

FIELD OF THE INVENTION

This invention relates to a paper sizing composition and internal and surface sizing methods using the same. More specifically, this invention relates to a ketene dimer sizing composition having excellent storage stability at high concentration, mechanical stability and sizing effect and uses thereof.

BACKGROUND OF THE INVENTION

In the manufacture of ordinary paper and paperboard, so-called sizing is effected in order to provide the products with resistance to blotting, water resistance, waterproofness, etc. Such sizing includes so-called internal sizing in which a sizing agent is added to a pulp furnish during the papermaking process before a fiber sheet is formed and so-called surface sizing in which a sizing agent is applied on the surface of formed fiber sheet.

In internal sizing, conventionally there is employed an acid sizing method in which sizing is carried out in a pH range of 4.5–6.5 using a rosin sizing agent and crude aluminum sulfate. Recently, so-called neutral sizing is attracting attention. This sizing is carried out in a neutral or slightly alkaline pH range of 6.5–9, with the aim of using inexpensive calcium carbonate as a filler, using brokes or waste paper containing calcium carbonate, employing closed system in which water for papermaking is recycled, and producing permanent paper for books and documents.

Today, ketene dimer compounds, substituted cyclic dicarboxylic acid anhydride compounds, copolymers of a cationic monomer and a hydrophobic monomer, cationized petroleum resins, cationized aliphatic amides, etc. are used as sizing agents. Among these, aqueous dispersions of ketene dimer compounds are most widely used because of their superior sizing effect.

Conventionally, ketene dimer compounds are marketed and used in the form of aqueous dispersions in which the ketene dimers are dispersed together with starch, especially cationized starch, in a continuous aqueous phase. However, ketene dimer compounds are inherently reactive with water and are difficult to be provided as stable aqueous dispersions. Often these dispersions lose homogeneity and gel or form deposits during storage and thus lose their paper-sizing effect and waterproofing effect. It is very difficult to provide an aqueous dispersion sizing agent which is of high concentration, stable at high temperatures and mechanically stable.

In Japanese Laid-Open Patent Publication No. 60-258244(1985), a method for dispersing ketene dimer compounds in an aqueous continuous phase containing an acrylamide polymer having cationic groups is disclosed. However, the internal sizing composition in accordance with this method is still unsatisfactory in mechanical stability, storage stability, sizing effect, etc.

Meanwhile, surface sizing is advantageous in that it is not influenced by the quality and temperature of the water used in the papermaking and by the acidity or basicity (pH) of the water used in papermaking and enables economical use of the sizing agent and suitable process control.

As surface sizing agents, anionic water-soluble high polymers such as oxidized starch, phosphoric acid derivatives of starch, carboxymethyl cellulose, poly(vinyl alcohol), anionic acrylamide polymers, anionic styrene polymers, etc. are used. These anionic water-soluble high polymers react with aluminum ions of aluminum sulfate and become hydrophobic, whereby they exhibit sizing effect when applied to acidic paper in which aluminum sulfate is used. However, these anionic water-soluble high polymer sizing agents cannot exhibit sizing effect for neutral paper in which little or no aluminum sulfate is used.

Aqueous dispersions of ketene dimer compounds, which are commercially available today as neutral surface sizing agents, are known as sizing agents which exhibit excellent sizing effect not only for neutral paper but also for acidic paper.

In surface sizing, the sizing agent is prepared into a surface sizing solution under warmed condition, and the thus prepared surface sizing solution is recycled in use, during which the liquid suffers from the effects of heat and mechanical impact. Therefore, the surface sizing agent must be provided with resistance to heat and mechanical impact and low foaming property when it is recycled in use.

In surface sizing, the sizing agent is, on some occasions, required to provide paper with surface bonding strength and good printability in addition to blotting resistance. The above-mentioned anionic high polymers are used for such purpose. Therefore, the surface sizing agent is required to be provided with compatibility with such anionic water-soluble high polymers.

The ketene dimer composition in accordance with the above-mentioned Japanese Laid-Open Patent Publication No. 60-258244 is still unsatisfactory in compatibility with the above-mentioned anionic water-soluble high polymers.

DISCLOSURE OF THE INVENTION

We have conducted an extensive study in search of a solution of the above-mentioned problems and found that the problems are solved by a composition comprising (a) a ketene dimer compound represented by the formula

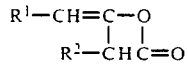

(I)

wherein $R^1$ and $R^2$ are the same or different hydrocarbyl groups having 8–30 carbon atoms, and (b) a polymer obtained by polymerizing or copolymerizing a hydrophilic vinyl monomer or monomers in the presence of an alkylmercaptan having 6–22 carbon atoms, in a content ratio of 100 parts by weight of the component (a) to 2–100 parts by weight of the component (b).

It is preferred that the component (b) contains 0.01–10 mole % of the alkylmercaptan having 6–22 carbon atoms for 100% of the vinyl monomer. Also, it is preferred that the polymer comprising vinyl monomers be a polymer of acrylamide, a copolymer of acrylamide and a cationic vinyl monomer, a copolymer of acrylamide and an anionic vinyl monomer, or a copolymer of acrylamide, a cationic vinyl monomer and an anionic vinyl monomer.

Further, this invention provides a method for internal sizing using the above-described sizing composition and a method for surface sizing using said composition.

The ketene dimer compounds represented by the above indicated chemical formula (I) are known and all of them can be used in the present invention.

In the formula (I), $R^1$ and $R^2$ are the same or different hydrocarbyl groups having 8–30 carbon atoms including alkyl groups such as decyl, dodecyl, tetradecyl, hexadecyl, octadecyl, eicosyl, etc.; alkenyl groups such as tetradecenyl, hexadecenyl, octadecenyl, etc.; alkyl-substituted phenyl groups such as octylphenyl, nonyphenyl, etc.; alkyl-substituted cycloalkyl groups such as nonylcyclohexyl, etc.; aralkyl groups such as phenylethyl, among which alkyl groups are preferred. The ketene dimer compounds can be used singly or in combination of more than one.

The polymer (b) in the composition of this invention is prepared by polymerizing or copolymerizing a vinyl monomer or monomers in the presence of an alkylmercaptan having 6–22 carbon atoms. The $C_{6-22}$ alkyl group can be straight-chained or branched. The alkyl groups thereof can be derived from natural sources or from ethylene or propylene which are produced by cracking of lower paraffins. Examples of usable alkyl mercaptans are n-octylmercaptan, n-dodecylmercaptan, tert-dodecylmercaptan, n-hexadecylmercaptan, n-octadecylmercaptan, etc. These can also be used singly or in combination of more than one. Among these, n-octylmercaptan and n-dodecylmercaptan are preferable.

In the preparation of the polymer (b), the alkylmercaptan having 6–22 carbon atoms, preferably 8–18 carbon atoms, is used preferably in an amount of 0.01–10 mol %, more preferably 0.05–2 mol % of the vinyl monomer or monomers to be polymerized or copolymerized. With less than 0.01 mol % of the alkylmercaptan, a stable sizing composition will not be obtained. When more than 10 mol % of the alkylmercaptan is used, there will remain unreacted alkylmercaptan which has not been introduced in the resulting polymer or copolymer and which will contaminate the reaction apparatuses and adversely affect the storage stability and sizing effect of the resulting product. It will further cause unnecessary increase in the material cost.

For the preparation of the polymer (b), cationic vinyl monomers such as (mono- or dialkyl)amino(hydroxy)alkyl (meth)acrylate, (mono- or dialkyl)aminoalkyl (meth)acrylamide, vinylpyridine, vinylimidazole, diallylamine, etc. as well as quaternary ammonium salt and inorganic or organic acid salts thereof can be used. As nonionic monomers, (meth)acrylamide, N,N-dimethylacrylamide, hydroxypropyl (meth)acrylate, etc. can be used. Further, as anionic vinyl monomers, vinyl monomers containing carboxylic acid radical such as (meth)acrylic acid, maleic acid, fumaric acid, itaconic acid, citraconic acid, crotonic acid, etc.; vinyl monomers containing sulfonic acid radical such as vinylsulfonic acid, (meth)allylsulfonic acid, 2-acrylamide-2-methylpropanesulfonic acid, sulfonated styrene, etc.; and vinyl monomers containing phosphoric acid ester moiety such as phosphoric acid ester of hydroxyalkyl (meth)acrylate, etc. can be used. Hydrophobic vinyl monomers, styrene and derivatives thereof, alkyl (meth)acrylate, (meth)acrylonitrile; vinyl esters such as vinyl acetate, vinyl propionate, etc.; methylvinylether, etc. can be used in combination with the above described hydrophilic monomers.

Of the polymers comprising these monomers, polymer of acrylamide, copolymers of acrylamide and cationic vinyl monomer or copolymers of acrylamide and anionic vinyl monomer are preferred; and copolymers of acrylamide, cationic vinyl monomer and anionic vinyl monomer are more preferred.

The polymers of (b) can be synthesized by known processes. To be specific, above mentioned vinyl monomers are polymerized in the presence of an alkylmercaptan having 6–22 carbon atoms in a lower alcohol such as methanol, ethanol, isopropyl alcohol, etc. or a mixture of one of these and water with the aid of a radical polymerization catalyst. The polymer is obtained by distilling off the alcohol solvent after the polymerization is finished. Radical polymerization catalysts usable in the present invention include persulfate salts such as ammonium persulfate, potassium persulfate, sodium persulfate; redox polymerization catalysts which are combinations of one of the above-mentioned persulfate and a reducing agent; azo catalysts such as 2,2'-azo-bis(2-amidinopropane) dihydrochloride, 2,2'-azo-bis-isobutyronitrile, etc. Known chain transfer agents can be used in combination with the above catalysts if desired.

The viscosity of the solution of the thus obtained polymer (b) should preferably be adjusted to 10–5000 cps, more preferably, 50–1000 cpsas measured as a 20% aqueous solution by a Brookfield viscometer at 60 rpm and 25° C. With viscosities less than 10 cps or greater than 5000 cps, the resulting sizing composition will be inferior in storage stability and mechanical stability in comparison with a product in which a solution having a viscosity of the above-defined range is used.

The polymer (b) is preferably used in an amount of 2–100 parts by weight, more preferably 2–50 parts by weight, for 100 parts by weight of the ketene dimer compound (a). With less than 2 parts by weight of the polymer, the resulting sizing compositions will be inferior in emulsification and storage stability and mechanical stability. When the polymer content is in excess of 100 parts by weight, it not only brings about economical disadvantage, but also adversely affects the sizing effect.

In the sizing composition of the present invention, high polymer protective colloid such as cationized starch, cationic, anionic or amphoteric acrylamide copolymers which are polymerized in the absence of the alkylmercaptan having 6–22 carbon atoms; anionic dispersants such as ligninsulfonic acid salt, naphthalenesulfonic acid-formaldehyde condensate, etc.; or nonionic dispersant such as sorbitan ester, etc. can be added to the extent that stability of the composition is not affected.

When the sizing composition of the present invention is used for surface sizing, preferably starch derivatives such as oxidized starch, starch phosphates, etc.; carboxymethyl cellulose, poly(vinyl alcohol); anionic water-soluble high polymers such as anionic acrylamide polymers are added to the composition in order to provide it with enhanced surface-bonding strength, printability, etc.

In this case, if the above-mentioned additives are not well dissolved or dispersed, the resulting coating composition suffers from formation of scum or sludge, increase in viscosity, poor operability, poor sizing effect, etc. Considering this fact, the polymer (b) should preferably be acrylamide polymer, copolymer of acrylamide and an anionic vinyl monomer, more preferably, copolymer of acrylamide, a cationic vinyl monomer and an anionic vinyl monomer wherein the cationic moiety occupies less than 0.6 equivalent for 1 equivalent of the anionic moiety. The sizing compositions of the present invention prepared using the above polymer exhibit excellent compatibility with the above-mentioned anionic water-soluble high polymer.

The sizing composition of the present invention can be prepared by methods known per se. For instance, the dispersion can be prepared by mixing a ketene dimer compound (a) and a polymer (b), and the above-mentioned protective colloid or dispersant if necessary, in an aqueous medium at a temperature higher than the melting point of said ketene dimer compound and homogeneously dispersing the mixture by means of known emulsifying apparatus such as a homomixer, a high pressure homogenizer, an ultrasonic emulsifier, etc.

The thus prepared sizing composition of the present invention comprises dispersed particles the diameter of which is not larger than 10 $\mu$, is less foaming, has excellent storage stability and mechanical stability at the concentration of 15–30% by weight and exhibits excellent sizing effect.

It is considered that the excellent properties of the composition of the present invention is achieved by the polymer (b) which is prepared by polymerizing a vinyl monomer or copolymerizing monomers in the presence of an alkylmercaptan having 6–22 carbon atoms. That is, the mercaptan is bonded to the terminal portions of the formed polymer and such polymer works as an excellent dispersant and protective colloid for said ketene dimer compound.

The sizing composition of the present invention has excellent storage and mechanical stability and sizing effect whether the polymer (b) is nonionic, cationic, anionic or amphoteric. This means that the polymer can be selected in accordance with the ionic property of other additives.

When the sizing composition of the present invention is used for internal sizing in the manufacture of paper and paperboard, the composition is added at the wet end.

The sizing composition of the present invention is added to the papermaking pulp slurry in an amount equivalent to 0.002–3%, preferably 0.005–2% by weight of solid contents on the basis of the weight of the dry pulp.

Fillers, dyes, dry-strength improvers, wet-strength improvers, retention aids, etc. can be added to the pulp furnish in addition to the sizing composition as desired. Starches, polyvinyl alcohol, dyes, coating colors, surface sizing agents, slip-preventing agents, etc. can be applied on the surface of the thus internally-sized formed paper by means of a size press, gate roll coater, Billblade coater, calender, etc.

When the sizing composition of the present invention is used for surface sizing, the composition is applied to or impregnated in the fiber sheet after it is formed. That is, the composition is added to a sizing solution which is applied on the paper surface by a size press, gate roll coater, Billblade coater, calendar, etc. in an amount such that the solid content of the composition is applied to the paper at a rate of 0.005–0.5 g/m$^2$, preferably 0.01–0.2 g/m$^2$. The surface sizing solution can contain the above-mentioned anionic water-soluble high polymer, dye, other additives such as dry-strength improver, wet-strength improver, etc.

The paper to which the sizing composition of the present invention is applied as a surface size is not specifically limited. The paper may already contain an internal sizing agent.

The sizing composition of the present invention is applicable to papers comprising bleached or unbleached pulp such as kraft pulp, and sulfite pulp; bleached or unbleached high yield pulp such as ground wood pulp, mechanical pulp, thermomechanical pulp, waste paper (newspaper and magazine), waste corrugated board, deinked waste paper, etc.

The sizing composition of the present invention exhibits excellent sizing effect and storage and mechanical stability because of the alkylmercaptan having 6–22 carbon atoms which is introduced into the vinyl polymer as one component of the present sizing composition.

SPECIFIC DESCRIPTION OF THE INVENTION

Now the invention will be illustrated by way of working examples and comparative examples. However, it should be understood that the invention is not limited to these specific embodiments. In the following examples, the terms "percentage" and "part" mean those by weight with respect to the solid contents, if not specifically defined otherwise.

EXAMPLE 1 (1 NO JISSIREI 1)

In a 1 liter four-necked flask equipped with a stirrer, a thermometer, a reflux condenser and a nitrogen-introducing port, 12.58 g of dimethylaminoethyl methacrylate, 213.9 g of a 50% aqueous solution of acrylamide, 2.08 g of itaconic acid, 166.7 g of deionized water, 212.8 g of isopropyl alcohol and 1.62 g of n-dodecylmercaptan were placed. The pH of the mixture was adjusted to 4.0 with a 20% sulfuric acid aqueous solution. Oxygen in the flask was replaced by nitrogen by introducing the latter while the mixture was stirred. Thereafter, the reaction mixture was warmed to 60° C. and 3.65 g of a 5% aqueous solution of ammonium persulfate was added to start polymerization. The temperature was raised to 78° C. After the reaction mixture had been stirred at the same temperature for 1.5 hours, 1.10 g of the 5% ammonium persulfate solution was further added and the reaction was allowed to continue at the same temperature for another hour. Then 200 g of deionized water was added and removal of isopropyl alcohol by distillation was started. After 2 hours, 271.5 g of the mixture of isopropyl alcohol and water was collected and thus distillation was finished. 71.5 g of deionized water was added to the remaining polymerization product. The thus obtained polymer solution contained 20.4% of non-volatiles, and was tested for its viscosity by a Brookfield viscometer operated at 60 rpm and 25° C. The Brookfield viscosity was 420 cps and the pH of the solution was 4.6. The product is designated as P-1.

One hundred (100) parts of a ketene dimer compound (prepared by dehydrochlorination of fatty acid chloride derived from a fatty acid mixture comprising 40% palmitic acid and 60% stearic acid and 98 parts of the polymer solution P-1 obtained as described above and 282 parts of deionized water were mixed and the mixture was warmed to 70° C. and was preliminarily dispersed by a homomixer. Then the mixture was completely dispersed by passing it through a high pressure homogenizer twice under a shearing pressure of 250 kg/cm$^2$ while said temperature was being maintained. The mixture was cooled by adding some amount of deionized water and strained through a 325 mesh screen. Thus a sizing composition was obtained and designated as E-1. The content of the non-volatile ingredients, viscosity and pH of the composition E-1 were 20.2%, 15.4 cps and 3.5 respectively.

The composition E-1 was stored for 1 month at 32° C. and time course change of viscosity was measured. Also, mechanical stability was measured by a Maron stability tester. The results are shown in Table 2.

EXAMPLES 2–13

The procedures of Example 1 were repeated except that different kinds of alkylmercaptans and vinyl monomers were used as indicated in Table 1 whereby polymer solutions P-2 to P-13 were obtained. For adjustment of viscosity of the solutions, different amounts of isopropyl alcohol were suitably employed.

Further, the procedures of Example 1 were followed and sizing compositions E-2 to E-13 were obtained. The storage stability and mechanical stability of these compositions were measured in the same manner as in Example 1. The results are shown in Table 2.

COMPARATIVE EXAMPLES 1–5

In the same manner as in Examples 2–13, polymer solutions RP-1 to RP-5 were prepared. Using these polymer solutions, sizing compositions RE-1 to RE-5 were prepared. Storage stability and mechanical stability thereof were measured in the same manner. The results are shown in Table 2.

In Table 1, the symbols mean:

M-1: n-dodecylmercaptan
M-2: n-octylmercaptan
M-3: t-dodecylmercaptan
M-4: n-hexadecylmercaptan
M-5: n-octadecylmercaptan
M-6: n-butylmercaptan
M-7: thiophenol
C-1: dimethylaminoethyl methacrylate
C-2: C-1 quaternized with methyl chloride
C-3: dimethylaminopropyl acrylamide
C-4: dimethylaminopropyl methacrylamide
A-1: itaconic acid
A-2: maleic acid
A-3: acrylic acid

COMPARATIVE EXAMPLES 6–8

Storage stability and mechanical stability of three kinds of commercially available papermaking internal sizing agents RE-6 to RE-8 were checked for the purpose of comparison. The results are shown in Table 2.

The ketene dimer compound used in these Examples and Comparative Examples 1–5 was derived from a mixture of 40% palmitic acid and 60% stearic acid. The polymer solutions were as indicated in Table 1. Storage stability is represented by the viscosity after storage at 32° C. for 1 month. Mechanical stability is represented by the weight of solid materials remaining on the screen when 50 g of each sizing composition was agitated by a Maron tester under a load of 20 kg/cm$^2$ at 1000 rpm for 10 min and strained through a 100 mesh screen. The test was started at 25° C. The larger the amount of the solid-materials remaining on the screen, the poorer the mechanical stability.

The above-listed sizing compositions were tested for their sizing effect.

Test 1

To a 2.4% concentration pulp slurry (hardwood bleached kraft pulp, Canadian standard freeness 400 ml), 0.5% of crude aluminum sulfate, 0.3% of cationized starch ("Cato F" marketed by Oji-National Kabushiki Kaisha) were added in this order, and the mixture was stirred for 2 minutes. Then the slurry was diluted to 0.24% and respectively 0.15% of the sizing compositions E-1 to E-6, RE-1 to RE-2 and RE-5 to RE-8 obtained in Examples 1–6, Comparative Examples 1, 2, 5–8 were added thereto. After the mixtures were stirred for 1 minute, 20% of precipitated calcium carbonate ("Tamapearl" marketed by Oku-Tama Kogyo Kabushiki Kaisha) was added and the mixtures were stirred for 1 minute and then 0.02% of an anionic retention aid ("Hi Reten 501" marketed by DIC-Hercules Kabushiki Kaisha) was added and the mixture was stirred for 1 min. From the thus prepared paper stock, wet paper having an basis weight of 70 g/m$^2$ was made by a hand papermaking machine, a product of Noble and Wood Co. The running pH was 8.0. The wet paper was pressed until the water content became 58.0% and dried in a drum dryer at 80° C. for 70 sec. Immediately after drying, the water content was 3.5%. After the paper had been conditioned in an atmosphere of 20° C. and 65% RH for 24 hours, the Stöckigt sizing degree of the paper was measured. The addition rate of the all wet end chemicals were on the dry basis of bone dried pulp. The results are shown in Table 3.

Test 2

To a 2.4% concentration pulp slurry (hardwood bleached kraft pulp, Canadian standard freeness 400 ml), 0.5% of crude aluminum sulfate, 0.3% of cationized starch ("Cato F" marketed by Oji-National Kabushiki Kaisha) were added in this order, and the mixture was stirred for 2 minutes. Then the slurry was diluted to 0.24% concentration and respectively 0.16% of the sizing compositions obtained in Examples 7–13, Comparative Examples 3–8 and further 0.02% of a cationic retention aid ("Hi Reten 104" marketed by DIC-Hercules Kabushiki Kaisha) were added and the mixtures were stirred for 1 min. From the thus prepared paper stock, wet paper having a basis weight of 70 g/m$^2$ was made and the Stöckigt sizing degree of the paper was measured in the same manner as in Test 1. The results are shown in Table 4.

From the above description, it is apparent that the sizing compositions of the present invention have excellent storage and mechanical stability as well as excellent internal sizing effect.

EXAMPLE 14 (2 no Jissirei 1)

In a 1 liter four-necked flask equipped with a stirrer, a thermometer, a reflux condenser and a nitrogen-introducing port, 31.1 g of 2-acrylamido-2-methylpropanesulfonic acid, 192.0 g of a 50% aqueous solution of acrylamide, 190.0 g of deionized water, 222.4 g of isopropyl alcohol and 1.52 g of n-dodecylmercaptan were placed. The pH of the mixture was adjusted to 4.0 with a 20% sodium hydroxide aqueous solution. Oxygen in the flask was replaced by nitrogen by introducing the latter while the mixture was stirred. Thereafter, the reaction mixture was warmed to 60° C. and 3.42 g of a 5% aqueous solution of ammonium persulfate was added to start polymerization. The temperature was raised to 78° C. After the reaction mixture had been stirred at the same temperature for 1.5 hours, 1.05 g of the 5% ammonium persulfate solution was further added and the reaction was allowed to continue at the same temperature for another hour. Then 200 g of deionized water was added and removal of isopropyl alcohol by distillation was started. After 2 hours, 285.5 g of the mixture of isopropyl alcohol and water was collected and thus distillation was finished. 85.5 g of deionized water was added to the remaining polymerization product. The thus obtained polymer solution contained 20.3% non-volatiles, and was tested for its viscosity by a Brookfield viscometer operated at 60 rpm and 25° C. The Brookfield viscosity was 220 cps and the pH of the solution was 4.3. The product is designated as P-14.

One hundred (100) parts of a ketene dimer compound (derived from 40% palmitic acid and 60% stearic acid) and 123 parts of the polymer solution P-14 obtained as described above and 277 parts of deionized water were mixed and the mixture was warmed to 70° C. and was preliminarily dispersed by a homomixer. Then the mixture was completely dispersed by passing it through a high pressure homogenizer twice under a shearing pressure of 250 kg/cm$^2$ while said temperature was being maintained. The mixture was cooled by adding some amount of deionized water and strained through a 325 mesh screen. Thus a sizing composition was obtained and was designated as E-14. The content of the non-volatile ingredients, viscosity and pH of the composition E-14 were 20.2%, 12.4 cps and 3.4 respectively.

EXAMPLES 15–21

The procedures of Example 14 were repeated except that different kinds of alkylmercaptans and vinyl monomers were used as indicated in Table 5 and polymer solutions P-15 to P-21 were obtained. For adjustment of viscosity of the solutions, different amounts of isopropyl alcohol were suitably employed.

Further, procedures of Example 14 were followed and sizing compositions E-15 to E-21 were obtained.

COMPARATIVE EXAMPLES 9–11

The procedures of Example 14 were repeated except that different kinds of mercaptans and vinyl monomers were used as indicated in Table 5 and polymer solutions RP-9 to RP-11 were obtained. Sizing compositions RE-9 to RE-11 were prepared in the same manner as in Example 14. Compositions and properties of the sizing compositions E-14 to E-21, RE-9 to RE-11 obtained in Examples 14 to 21 and Comparative Examples 9 to 11 are summarized in Table 6.

In Table 5, the symbols for mercaptans and vinyl monomers mean as follows:

M-1: n-dodecylmercaptan
M-2: n-octylmercaptan
M-3: t-dodecylmercaptan
M-4: n-hexadecylmercaptan
M-5: n-octadecylmercaptan
M-6: n-butylmercaptan
M-7: thiophenol
A-1: 2-acrylamido-2-methylpropane-sulfonic acid
A-2: acrylic acid
A-3: itaconic acid
C-1: dimethylaminopropyl acrylamide
C-2: dimethylaminopropyl methacrylamide The storage and mechanical stability of the sizing compositions obtained in Example 14–21 and Comparative Examples 9–11 were measured in the same manner as in Example 1, the results are shown in Table 7.

Each of the compositions of Examples 15–21 and Comparative Examples 9–11 was mixed with oxidized starch to form a coating liquid. Thermal and mechanical properties of the compositions were measured by the following methods and the results are shown in Table 7.

Thermal and Mechanical Stability Test

Fifty (50) grams of size press solutions respectively composed of 5% sizing composition and oxidized starch ("Oji Ace A" manufactured by Oji Starch Kabushiki Kaisha) were prepared. Each solution was agitated by means of a Maron tester under a load of 20 kg/cm$^2$ and 1000 rpm for 10 min, and strained with a 100 mesh screen and the weight of the solid materials remaining on the screen was measured. The test was started at 50° C.

Test for Foaming Property of Surface Sizing Solution

Two hundred (200) ml of a surface sizing solution containing a sizing composition (0.2% as solid content) and oxidized starch (5% as solid content) was warmed to 50° C. and placed in a cylindrical vessel 6 cm in diameter provided with a scale and thermostat mechanism. Air was blown in at the rate of 40 liters/hour by means of an air pump. The height of the resulting foam was measured 1 min and 10 min after the air blowing was started. After 10 min, air blowing was ceased and occurrence of scum was observed by the naked eye.

The surface sizing solution comprising the sizing compositions obtained in Examples 9–21 and Comparative Examples 9–11 and oxidized starch were applied to slack sized paper by means of a laboratory size press manufactured by Kumagaya Riki Kogyo Kabushiki Kaisha and sizing effect was checked. The results are shown in Table 8.

The test conditions were as follows:

| | | |
|---|---|---|
| Base paper | | |
| Pulp: | Bleached kraft pulp, hardwood/softwood = 8/2 | |
| Internal additives: | ground calcium carbonate ash content: | 16.7% |
| | Hercon W (ketene dimer internal sizing agent marketed by DIC-Hercules K.K.): | 0.05% |
| | Cationic starch: | 0.75% |
| Running pH: | 8.0 | |
| Basis weight: | | |
| Coating weight: | | |
| Surface sizing composition: | 0.03 g/m$^2$ as solid | |
| Oxidized starch (supplied by Oji Corn Starch Karbushiki Kaisha): | 1.00 g/m$^2$ as solid | |
| Operation of size press: | | |
| Press rate: | 10 m/min | |
| Nip pressure: 20 kg/cm | | |
| Temp. of the sizing solution: | 50° C. | |
| Drying | 80° C., 50 sec. in a drum drier | |

-continued

| Sizing test: | Stöckigt method (JIS P-8122) |
|---|---|

From the above described examples and comparative examples, it is apparent that the sizing compositions of the present invention are very effective as surface sizing agents.

TABLE 1

| | | Composition and Properties of Polymers (b) | | | | | | |
|---|---|---|---|---|---|---|---|---|
| | | Species and Amount of | Comp. of Polymer (mol 5) | | | Properties | | |
| Example | Desig-naton | Mercaptan (mol %) | Cationic Monomer | Anionic Monomer | Acryl-amide | Non-volatile (%) | Visc'y (cps) | pH |
| Examples | | | | | | | | |
| 1 | P-1 | (M-1) 0.5 | (C-1) 5 | (A-1) 1 | 94 | 20.4 | 420 | 4.6 |
| 2 | P-2 | (M-2) 0.8 | (C-2) 5 | (A-1) 1 | 94 | 20.2 | 268 | 4.5 |
| 3 | P-3 | (M-3) 1.0 | (C-3) 8 | (A-2) 2 | 90 | 20.5 | 225 | 4.2 |
| 4 | P-4 | (M-4) 0.5 | (C-4) 2 | (A-1) 1 | 97 | 20.2 | 418 | 4.8 |
| 5 | P-5 | (M-5) 0.2 | (C-1) 3 | — | 97 | 20.2 | 600 | 4.6 |
| 6 | P-6 | (M-2) 0.05 | (C-3) 10 | (A-3) 3 | 87 | 20.5 | 320 | 4.7 |
| 7 | P-7 | (M-1) 0.3 | (C-1) 2 | (A-1) 3 | 95 | 20.5 | 380 | 4.7 |
| 8 | P-8 | (M-2) 0.8 | (C-4) 1 | (A-1) 2 | 97 | 20.2 | 210 | 4.5 |
| 9 | P-9 | (M-3) 1.0 | (C-2) 1 | (A-2) 3 | 96 | 20.0 | 290 | 4.6 |
| 10 | P-10 | (M-4) 0.5 | (C-3) 2 | (A-3) 5 | 93 | 20.1 | 350 | 4.8 |
| 11 | P-11 | (M-5) 0.5 | (C-3) 0.5 | (A-1) 3 | 96.5 | 20.3 | 420 | 4.9 |
| 12 | P-12 | (M-1) 0.5 | — | (A-1) 2 | 98 | 20.3 | 310 | 4.3 |
| 13 | P-13 | (M-1) 0.5 | — | — | 100 | 20.2 | 560 | 4.7 |
| Comp. Ex | | | | | | | | |
| 1 | RP-1 | (M-6) 0.5 | (C-1) 5 | (A-1) 1 | 94 | 20.0 | 120 | 4.8 |
| 2 | RP-2 | (M-7) 0.5 | (C-1) 5 | (A-1) 1 | 94 | 20.3 | 265 | 4.4 |
| 3 | RP-3 | (M-6) 0.5 | (C-1) 1 | (A-1) 2 | 97 | 20.2 | 280 | 4.7 |
| 4 | RP-4 | (M-7) 0.5 | (C-3) 1 | (A-2) 3 | 96 | 20.1 | 250 | 4.8 |
| 5 | RP-5 | — | (C-1) 5 | (A-1) 1 | 94 | 20.3 | 620 | 4.6 |

TABLE 2

| | | Composition of Internal Sizing Compositions and Properties Thereof | | | | | | |
|---|---|---|---|---|---|---|---|---|
| | | Composition | | Properties | | | | |
| Example | Desig-naton | Ketene dimer | Polymer Solution (Table 1) | Non-volatile (%) | Visc'y (cps) | pH | Storage Stab'y (cps) | Mech. Stab'y (g) |
| Examples | | | | | | | | |
| 1 | E-1 | 100 | (P-1) 20 | 20.2 | 15.4 | 3.5 | 19.8 | 0.21 |
| 2 | E-2 | 100 | (P-2) 25 | 25.4 | 45.0 | 3.4 | 88.0 | 0.25 |
| 3 | E-3 | 100 | (P-3) 50 | 20.5 | 14.0 | 3.4 | 17.9 | 0.28 |
| 4 | E-4 | 100 | (P-4) 25 | 20.2 | 12.5 | 3.6 | 18.5 | 0.26 |
| 5 | E-5 | 100 | (P-5) 10 | 20.0 | 18.0 | 3.7 | 29.0 | 0.30 |
| 6 | E-6 | 100 | (P-6) 30 | 20.5 | 11.0 | 3.4 | 15.0 | 0.22 |
| 7 | E-7 | 100 | (P-7) 20 | 20.3 | 14.8 | 3.5 | 18.6 | 0.21 |
| 8 | E-8 | 100 | (P-8) 25 | 20.2 | 12.5 | 3.6 | 17.9 | 0.26 |
| 9 | E-9 | 100 | (P-9) 10 | 20.0 | 11.5 | 3.5 | 19.2 | 0.29 |
| 10 | E-10 | 100 | (P-10) 30 | 20.1 | 12.0 | 3.7 | 21.5 | 0.30 |
| 11 | E-11 | 100 | (P-11) 25 | 20.2 | 13.5 | 3.4 | 20.2 | 0.34 |
| 12 | E-12 | 100 | (P-12) 30 | 20.1 | 35.3 | 3.0 | 40.2 | 0.31 |
| 13 | E-13 | 100 | (P-13) 25 | 20.2 | 14.5 | 3.4 | 19.5 | 0.29 |
| Comp. Ex | | | | | | | | |
| 1 | RE-1 | 100 | (RP-1) 25 | 20.4 | 19.5 | 3.5 | creaming | 1.03 |
| 2 | RE-2 | 100 | (RP-2) 25 | 20.5 | 17.0 | 3.4 | " | 1.10 |
| 3 | RE-3 | 100 | (RP-3) 25 | 20.2 | 18.5 | 3.5 | " | 1.15 |
| 4 | RE-4 | 100 | (RP-4) 25 | 20.1 | 20.5 | 3.5 | " | 1.20 |
| 5 | RE-5 | 100 | (RP-5) 25 | 20.7 | 22.0 | 3.6 | " | 1.25 |
| 6 | RE-6 | Commerc. Product A | | 15.2 | 15.0 | 2.9 | 230 | 0.40 |
| 7 | RE-7 | Commerc. Product B | | 20.0 | 6.2 | 2.7 | 130 | 1.05 |
| 8 | RE-8 | Commerc. Product C | | 20.2 | 3.4 | 3.4 | 10 | 0.48 |

TABLE 3

| Internal Sizing Compositions and Stöckigt Sizing Degree (Test 1) | | |
|---|---|---|
| Size Comp. | Desig | Stöckigt Sizing Degree (sec) |
| Examples | | |
| 1 | E-1 | 17.6 |
| 2 | E-2 | 18.0 |
| 3 | E-3 | 16.8 |
| 4 | E-4 | 16.5 |
| 5 | E-5 | 16.7 |
| 6 | E-6 | 17.8 |

TABLE 3-continued

| Internal Sizing Compositions and Stockigt Sizing Degree (Test 1) | | |
|---|---|---|
| Size Comp. | Desig | Stockigt Sizing Degree (sec) |

TABLE 3-continued

| Internal Sizing Compositions and Stockigt Sizing Degree (Test 1) | | |
|---|---|---|
| Size Comp. | Desig | Stockigt Sizing Degree (sec) |
| Comp. Ex. | | |
| 1 | RE-1 | 13.8 |
| 2 | RE-2 | 14.0 |
| 5 | RE-5 | 12.5 |
| 6 | RE-6 | 6.8 |
| 7 | RE-7 | 6.5 |
| 8 | RE-8 | 10.0 |

TABLE 4

| Composition and Stöchgt Sizing Degree of Internal Sizing Compositions (Test 2) | | |
|---|---|---|
| Size Comp. | Desig | Stöckigt Sizing Degree (sec) |
| Examples | | |
| 7 | E-7 | 19.0 |
| 8 | E-8 | 18.7 |
| 9 | E-9 | 18.0 |
| 10 | E-10 | 17.9 |
| 11 | E-11 | 18.2 |
| 12 | E-12 | 16.1 |
| 13 | E-13 | 15.8 |
| Comp. Ex. | | |
| 3 | RE-3 | 13.8 |
| 4 | RE-4 | 14.0 |
| 5 | RE-5 | 7.2 |
| 6 | RE-6 | 7.5 |
| 7 | RE-7 | 7.7 |
| 8 | RE-8 | 10.1 |

TABLE 5

| Composition and Properties of Porymers (b) | | | | | | | | |
|---|---|---|---|---|---|---|---|---|
| | | Species and Amount of | Composition of Vinyl Monomer (mol %) | | | Properties | | |
| Example | Desig-naton | Mercaptan (mol %) | Anionic Vinyl Monomer | Cationic Vinyl Monomer | Acryl-amide | Non-volatile (%) | Visc'y (cps) | pH |
| Examples | | | | | | | | |
| 14 | P-14 | (M-1) 0.5 | (A-1) 10 | — | 90 | 20.3 | 220 | 4.3 |
| 15 | P-15 | (M-2) 0.2 | (A-2) 10 | — | 90 | 20.0 | 160 | 4.2 |
| 16 | P-16 | (M-3) 0.05 | (A-3) 5 | — | 95 | 20.4 | 175 | 4.4 |
| 17 | P-17 | (M-4) 1.0 | (A-1) 10<br>(A-2) 2 | (C-1) 1 | 87 | 20.2 | 190 | 4.2 |
| 18 | P-18 | (M-5) 0.5 | (A-1) 15 | (C-2) 2 | 83 | 20.1 | 185 | 4.3 |
| 19 | P-19 | (M-1) 0.3 | (A-1) 10<br>(A-2) 2 | (C-1) 2 | 86 | 20.2 | 170 | 4.2 |
| 20 | P-20 | (M-2) 0.3 | (A-1) 10<br>(A-3) 1 | (C-2) 2 | 87 | 20.4 | 185 | 4.3 |
| 21 | P-21 | (M-1) 0.5 | — | — | 100 | 20.3 | 260 | 4.2 |
| Comp. Ex. | | | | | | | | |
| 9 | RP-9 | (M-6) 0.5 | (A-1) 10 | — | 90 | 20.3 | 165 | 4.2 |
| 10 | RP-10 | (M-7) 0.5 | (A-2) 10 | — | 90 | 20.2 | 210 | 4.2 |
| 11 | RP-11 | — | (A-2) 10 | — | 90 | 20.2 | 225 | 4.2 |

TABLE 6

| Composition of Surface Sizing Compositions and Properties Thereof | | | | | | |
|---|---|---|---|---|---|---|
| | | Composition | | Properties | | |
| Surface Sizing Comp. | Desig. | Ketene Dimer | Polymer Solution (Table 5) | Non-Volatile (%) | Visc'y (cps) | pH |
| Examples | | | | | | |
| 14 | E-14 | 100 | (P-14) 25 | 20.2 | 12.4 | 3.4 |
| 15 | E-15 | 100 | (P-15) 20 | 20.4 | 11.8 | 3.4 |
| 16 | E-16 | 100 | (P-16) 10 | 20.5 | 11.0 | 3.5 |
| 17 | E-17 | 100 | (P-17) 50 | 20.4 | 12.2 | 3.4 |
| 18 | E-18 | 100 | (P-18) 25 | 20.2 | 12.1 | 3.3 |
| 19 | E-19 | 100 | (P-19) 20 | 20.4 | 11.5 | 3.4 |
| 20 | E-20 | 100 | (P-20) 20 | 20.3 | 11.8 | 3.5 |
| 21 | E-21 | 100 | (P-21) 25 | 20.1 | 12.5 | 3.4 |
| Comp. Ex. | | | | | | |
| 9 | RE-9 | 100 | (RP-10) 25 | 20.2 | 15.0 | 3.4 |
| 10 | RE-10 | 100 | (RP-11) 25 | 20.4 | 14.5 | 3.4 |
| 11 | RE-11 | 100 | (RP-3) 25 | 20.2 | 19.5 | 3.5 |

TABLE 7

| Composition of Surface Sizing Composition and Properties Thereof | | | | | | | | |
|---|---|---|---|---|---|---|---|---|
| | | Storage Stability | | | Thermal and Mechanical | Foaming Property | | |
| Surface Sizing Comp. | Desig | Initial State (cps) | After 1 month (cps) | Mechanical Stability | Stability of Coating Solution | after 1 min. (mm) | after 10 min. (mm) | Scum |
| Examples | | | | | | | | |
| 1 | E-14 | 12.4 | 17.8 | 0.38 | 0.03 | 10 | 10 | Not Observed |
| 2 | E-15 | 11.8 | 17.2 | 0.42 | 0.04 | 12 | 12 | " |
| 3 | E-16 | 11.0 | 19.5 | 0.40 | 0.03 | 10 | 10 | " |
| 4 | E-17 | 12.2 | 18.9 | 0.48 | 0.05 | 12 | 13 | " |
| 5 | E-18 | 12.1 | 27.5 | 0.46 | 0.05 | 15 | 15 | " |
| 6 | E-19 | 11.5 | 17.3 | 0.29 | 0.02 | 8 | 8 | " |
| 7 | E-20 | 11.8 | 17.5 | 0.30 | 0.02 | 8 | 8 | " |
| 8 | E-21 | 12.5 | 18.0 | 0.38 | 0.04 | 14 | 15 | " |
| Comp. Ex. | | | | | | | | |
| 1 | RE-9 | 15.0 | creaming | 1.02 | 0.35 | 35 | 52 | Observed |
| 2 | RE-10 | 14.5 | " | 1.01 | 0.37 | 37 | 60 | " |
| 3 | RE-11 | 19.5 | " | 1.15 | 0.40 | 32 | 48 | " |

TABLE 8

| Sizing Compositions and Stöckigt Sizing Degree | | |
|---|---|---|
| Surface Sizing Comp | Desig | Stöckigt Size Degree (sec) |
| Examples | | |
| 14 | E-14 | 21.3 |
| 15 | E-15 | 20.0 |
| 16 | E-16 | 21.1 |
| 17 | E-17 | 20.8 |
| 18 | E-18 | 20.5 |
| 19 | E-19 | 22.4 |
| 20 | E-20 | 22.0 |
| 21 | E-21 | 19.0 |
| Comp. Ex. | | |
| 9 | RE-9 | 11.5 |
| 10 | RE-10 | 12.1 |
| 11 | RE-11 | 10.8 |
| Base Paper | — | 0.1 |

We claim:

1. A paper sizing composition comprising (a) 100 parts by weight of a ketene dimer compound represented by the formula

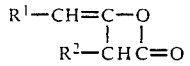

wherein $R^1$ and $R^2$ are the same or different hydrocarbyl group having 8–30 carbon atoms, and (b) 2–100 parts by weight of a hydrophilic polymer obtained by polymerizing or copolymerizing a hydrophilic vinyl monomer or monomers in the presence of an alkylmercaptan having 6–22 carbon atoms.

2. A paper sizing composition as recited in claim 1, wherein the vinyl polymer (b) contains 0.01–10 mol % of the alkylmercaptan having 6–22 carbon atoms.

3. A paper sizing composition as recited in claim 2, wherein the vinyl polymer (b) contains 0.05–2 mol % of of the alkymercaptan having 6–22 carbon atoms.

4. A paper sizing composition as recited in claim 2, which comprises 100 parts by weight of said ketene dimer compound and 2–50 parts by weight of a hydrophilic vinyl polymer.

5. A paper sizing composition as recited in claim 2, wherein the hydrophilic vinyl polymer (b) is a polymer of acrylamide.

6. A paper sizing composition as recited in claim 2, wherein the hydrophilic vinyl polymer is a copolymer of acrylamide and a cationic vinyl monomer.

7. A paper sizing composition as recited in claim 2, wherein the vinyl polymer is a copolymer of acrylamide and an anionic vinyl monomer.

8. A paper sizing composition as recited in claim 2, wherein the vinyl polymer is a copolymer of acrylamide, a cationic vinyl monomer and an anionic vinyl monomer.

9. A paper sizing composition as recited in claim 1, wherein the the hydrophilic vinyl polymer contains hydrophobic vinyl monomer.

10. A paper sizing composition as recited in claim 1, wherein the the hydrophilic vinyl polymer contains an alkylmercaptan having 8–18 carbon atoms.

11. A paper sizing composition as recited in claim 1, wherein said alkylmercaptan is n-octylmercaptan, n-dodecylmercaptan, t-dodecylmercaptan, n-hexadecylmercaptan or n-octadecylmercaptan.

12. A paper sizing composition as recited in claim 2, wherein the vinyl polymer (b) contains 0.05–2 mol % of said alkylmercaptan.

13. A paper sizing composition as recited in claim 1, wherein the polymer (b) is formed from one or more cationic vinyl monomers selected from the group consisting of (mono-or dialkyl) amino (hydroxy) alkyl (meth)acrylate, (mono- or dialkyl)amino alkyl (meth)acrylamide, vinyl pyridine, vinyl imidazole and diallylamine and quaternary ammonium, inorganic or organic salts thereof; nonionic monomers selected from the group consisting of (meth)acrylamide, N,N-dimethylacrylamide and hydroxypropyl(meth)acrylate; and anionic vinyl monomers selected from the group consisting of (meth)acrylic acid, maleic acid, fumaric acid, itaconic acid, citraconic acid, crotonic acid, vinyl sulfonic acid, (meth)allylsulfonic acid, 2-acrylamide-2-methylpropane sulfonic acid, sulfonated styrene, and the phosphoric acid ester of hydroxyalkyl(meth)acrylate.

* * * * *